US009635898B2

(12) United States Patent
Dow, II

(10) Patent No.: US 9,635,898 B2
(45) Date of Patent: May 2, 2017

(54) PROTECTIVE HELMET AND MUSIC STREAMING SYSTEM

(71) Applicant: Vigor Sports, Inc., Cerritos, CA (US)

(72) Inventor: John B Dow, II, Montebello, CA (US)

(73) Assignee: Vigor Sports, Inc., Cerritos, CA (US)

( * ) Notice: Subject to any disclaimer, the term of this patent is extended or adjusted under 35 U.S.C. 154(b) by 57 days.

(21) Appl. No.: 14/792,978

(22) Filed: Jul. 7, 2015

(65) Prior Publication Data

US 2017/0006955 A1 Jan. 12, 2017

(51) Int. Cl.

| | |
|---|---|
| ***H04R 25/00*** | (2006.01) |
| ***A42B 3/30*** | (2006.01) |
| ***A42B 3/10*** | (2006.01) |
| ***H04R 3/12*** | (2006.01) |
| ***H04R 1/10*** | (2006.01) |
| ***H04R 5/033*** | (2006.01) |
| ***A42B 3/12*** | (2006.01) |

(52) U.S. Cl.

CPC ..... *A42B 3/306* (2013.01); *A42B 3/10* (2013.01); *A42B 3/127* (2013.01); *H04R 1/1008* (2013.01); *H04R 1/1041* (2013.01); *H04R 1/1066* (2013.01); *H04R 3/12* (2013.01); *H04R 5/033* (2013.01); *H04R 2201/103* (2013.01)

(58) Field of Classification Search

CPC .... H04R 1/1008; H04R 1/1066; H04R 5/033; H04R 5/0335; H04R 2201/107; H04R 2420/07; H04R 1/1041; H04R 2201/103; H04R 2201/109; A42B 3/30; A42B 3/306; H04B 1/385; H04M 1/05; H04M 1/6041

USPC ..... 381/370, 374, 375, 376; 379/430; 2/209, 2/906; 455/90.3, 350, 351

See application file for complete search history.

(56) References Cited

U.S. PATENT DOCUMENTS

| | | | | |
|---|---|---|---|---|
| 5,119,505 | A * | 6/1992 | Tisseront | A42B 3/30 455/350 |
| 5,142,700 | A | 8/1992 | Reed | |
| 5,678,205 | A | 10/1997 | Gray | |
| 6,608,908 | B1 * | 8/2003 | Galet | A42B 3/30 379/430 |
| 6,725,020 | B2 | 4/2004 | Yagi | |
| 6,970,691 | B2 | 11/2005 | Thompson | |
| 6,978,162 | B2 | 12/2005 | Russell | |
| 7,519,405 | B1 | 4/2009 | Brent | |
| 8,688,040 | B2 | 4/2014 | Jung | |
| 8,706,043 | B2 | 4/2014 | Glezerman et al. | |
| 2010/0069002 | A1 | 3/2010 | Rong | |
| 2011/0081861 | A1 | 4/2011 | Kuo | |
| 2013/0093585 | A1 | 4/2013 | Ambani | |

FOREIGN PATENT DOCUMENTS

| | | |
|---|---|---|
| WO | WO2013065041 | 5/2013 |

* cited by examiner

*Primary Examiner* — Huyen D Le

(74) *Attorney, Agent, or Firm* — Eric Karich; Karich & Associates

(57) ABSTRACT

A protective helmet has a shell, a liner, and a control device that includes a receiver. A recess is formed in an outer surface of the liner adjacent a rear edge of the shell, to receive the control device. A battery operably connected with the control device, and side recesses formed in the outer surface of the liner adjacent the side edges of the shell contain speakers electronically connected to the control device. The control device streams music from the portable electronic device to the speakers.

12 Claims, 4 Drawing Sheets

PROTECTIVE HELMET AND MUSIC STREAMING SYSTEM

BACKGROUND OF THE INVENTION

Field of the Invention

This invention relates generally to protective helmets, and more particularly to a protective helmet that includes an integral components for streaming music to the user wearing the helmet.

Description of Related Art

The prior art teaches a variety of protective helmets that include various forms of electronics incorporated into the helmet for various purposes.

Reed, U.S. Pat. No. 5,142,700, for example, teaches a protective football helmet that includes a two-way radio system with speakers and microphones for enabling the player to talk with others (e.g., coaching staff, etc.).

Similar communications systems are also shown in Gray, U.S. Pat. No. 5,678,205, which teaches a protective fire-fighting helmet that includes a similar two-way communication system. The prior art teaches a wide range of similar helmets with similar communication systems.

The prior art also teaches various helmets that may be plugged into various forms of music playing systems. Thompson, U.S. Pat. No. 6,970,691, for example, teaches a bicycle helmet that includes speakers operably positioned on the sides of the helmet for playing music adjacent the ears of the user. The speakers are connected with wires to a port located at the back of the helmet, so that a music player can be connected with the speakers for playing music.

The prior art does not teach a protective helmet that includes a controller, a battery, and speakers operably mounted in the helmet for receiving and playing streaming music from a completely separate portable electronic device. The present invention fulfills these needs and provides further advantages as described in the following summary.

SUMMARY OF THE INVENTION

The present invention teaches certain benefits in construction and use which give rise to the objectives described below.

The present invention provides a protective helmet for providing head protection to a user, and for streaming music from a portable electronic device. The protective helmet comprises a shell and a liner. The shell is of impact-resistant material and has outer and inner surfaces bounded by a front edge, two side edges, and a rear edge. The liner is of impact-absorbing material and is disposed on the inner surface of the shell. A recess is formed in the outer surface of the liner adjacent the rear edge of the shell, to receive a control device having a receiver for receiving a transmission. The control device is mounted in the recess, between the liner and the shell. A battery operably connected with the control device, and side recesses formed in the outer surface of the liner adjacent the side edges of the shell contain speaker electronically connected to the control device. The helmet includes a means for streaming music from the portable electronic device to the speakers.

In one embodiment, the control device has a lower edge that includes a control mechanism for controlling the control device. The control device is mounted in the recess such that the control mechanism is positioned adjacent the rear edge of the shell.

A primary objective of the present invention is to provide a protective helmet having advantages not taught by the prior art.

Another objective is to provide a protective helmet that is able to stream music from a portable electronic device.

A further objective is to provide a protective helmet that does not need to be physically connected with the portable electronic device, and is therefore easy to use while engaged in various sporting activities.

In one embodiment, a further objective is to provide a control mechanism that is operably positioned adjacent the rear edge of the shell.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a protective helmet 10 that is used for providing head protection to a user, and also used in conjunction with a portable electronic device 70 for streaming music to a user wearing the protective helmet 10

Figure 1:
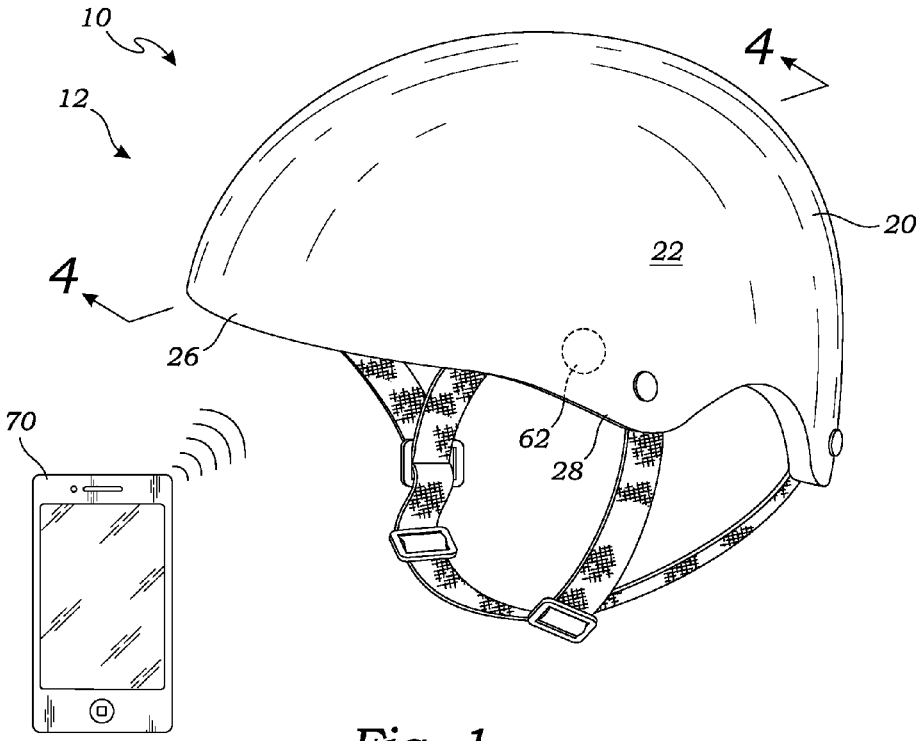
FIG. 1 is a perspective view of a protective helmet according to one embodiment of the present invention, also illustrating a portable electronic device that is used to stream music to the protective helmet.

FIG. 1 is a perspective view of the protective helmet 10 according to one embodiment of the present invention. As shown in FIG. 1, the protective helmet 10 is part of a music streaming system 12 that streams music from the portable electronic device 70 to the protective helmet 10 so that the user can listen to music while engaged in the sport.

Figure 2:
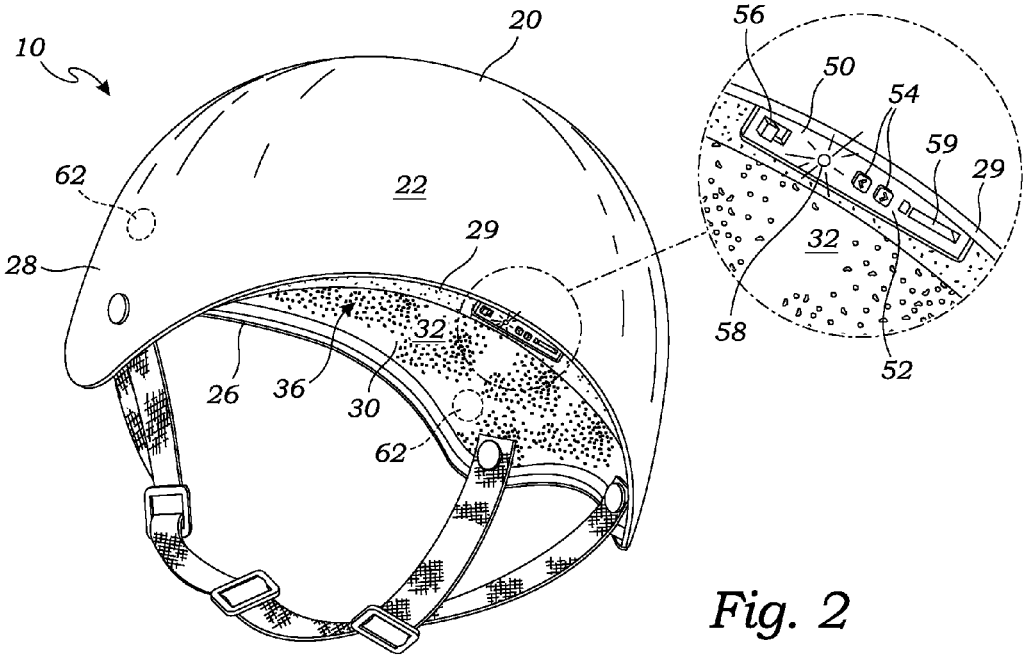
FIG. 2 is a rear perspective view of the protective helmet.
Figure 3:
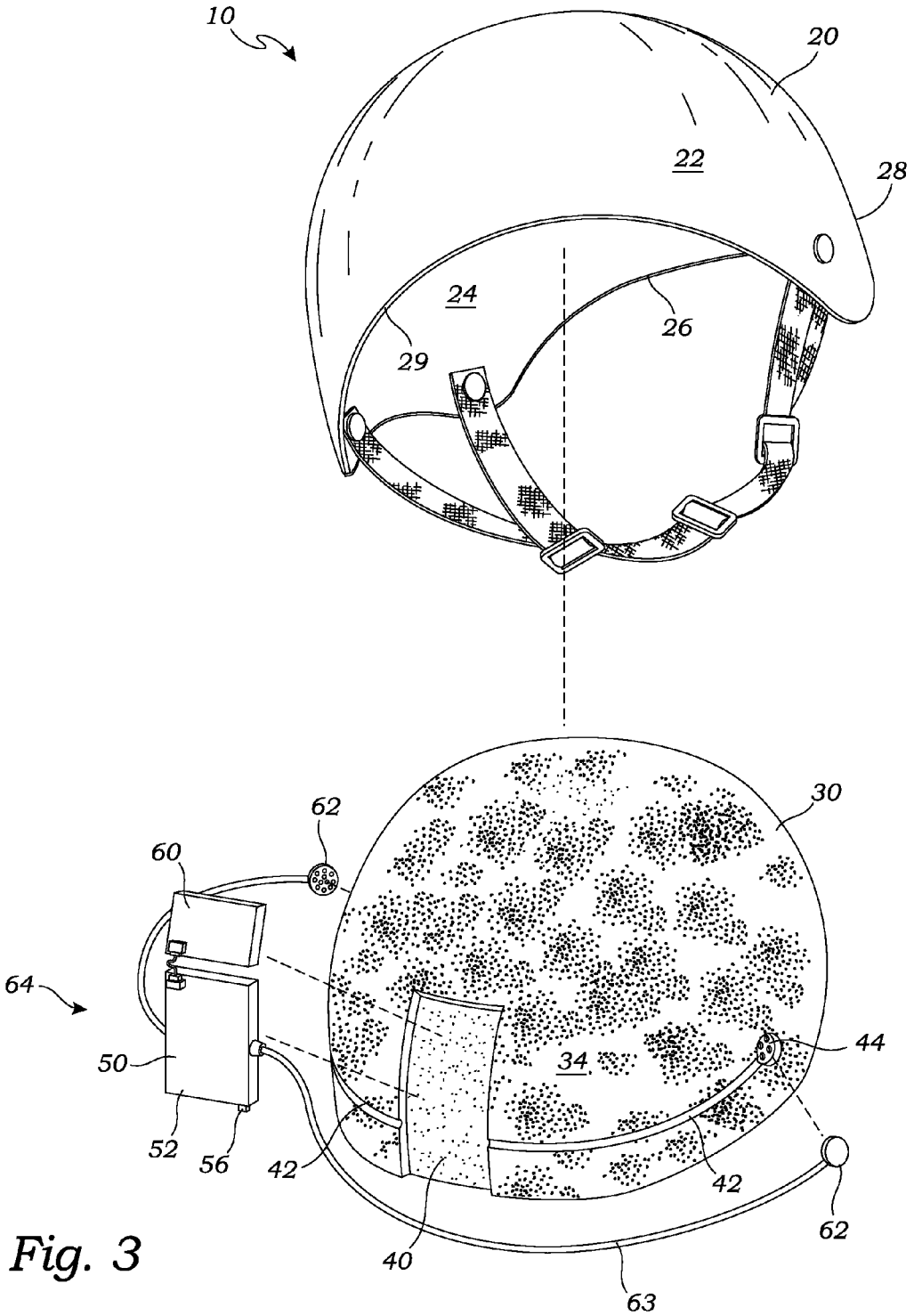
FIG. 3 is an exploded perspective view of the protective helmet.
Figure 4:
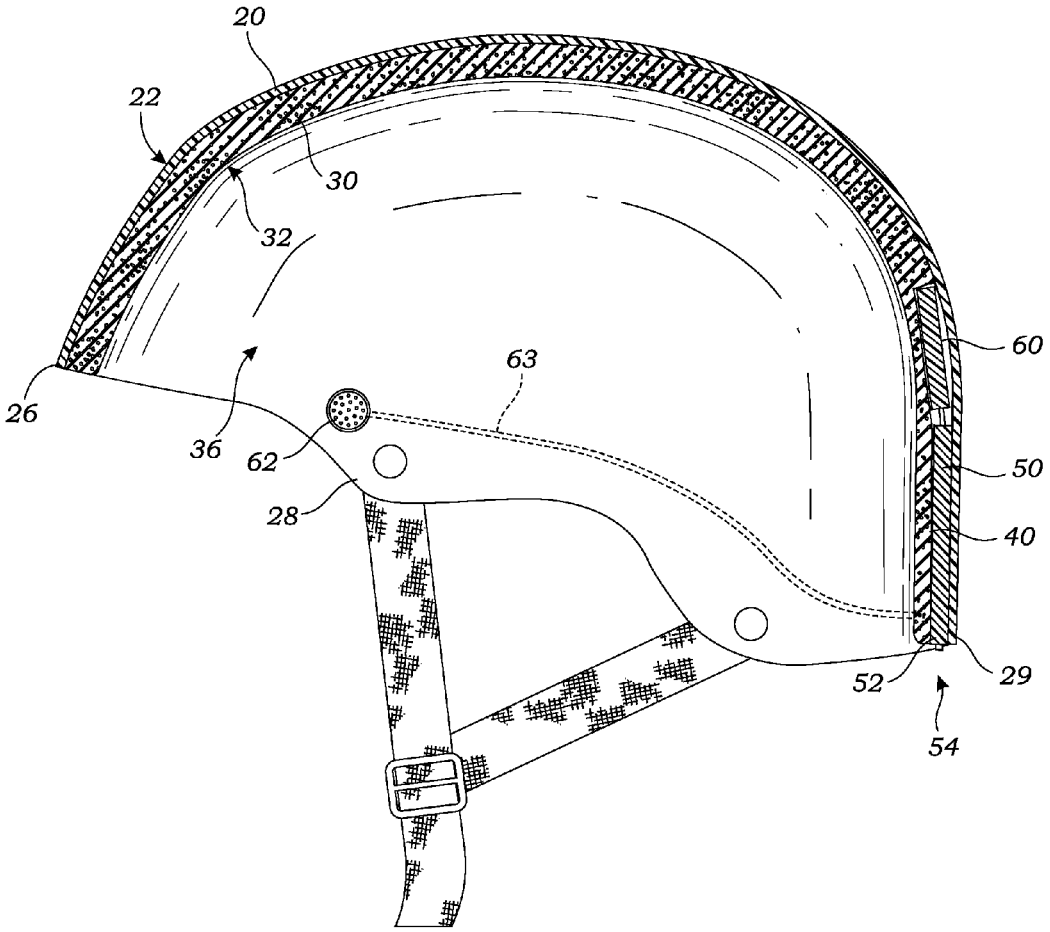
FIG. 4 is a sectional view thereof taken along line 4-4 in FIG. 1.

FIG. 2 is a rear perspective view of the protective helmet 10. FIG. 3 is an exploded perspective view of the protective helmet 10. FIG. 4 is a sectional view thereof taken along line 4-4 in FIG. 1. As shown in FIGS. 1-4, the protective helmet 10 has a construction that is similar to prior art helmets, and includes a shell 20 of impact-resistant material and a liner 30 of impact-absorbing material. The shell 20 includes outer and inner surfaces 22 and 24 bounded by a front edge 26, two side edges 28, and a rear edge 29, and may be the same as any of a number of prior art shells.

As shown in FIGS. 1-4, the liner 30 is disposed on the inner surface 24 of the shell 20. The liner 30 has an inner surface 32 and an outer surface 34, and the inner surface 32 of the liner 30 defines a head-receiving cavity 36 shaped for receiving the user's head. The outer surface 34 of the liner 30 contacts the inner surface 24 of the shell 20. For purposes of this application, the statement that the outer surface 34 of the liner 30 contacts the inner surface 24 of the shell 20, is defined to mean that at least a portion of the outer surface 34 contacts the shell 20, and portions of the liner 30 may not contact the shell 20, as described in greater detail below. Furthermore, while the liner 30 is illustrated as a single layer for simplicity, it may include multiple layers of different materials for providing maximum comfort and protection for the user wearing the helmet.

As shown in FIGS. 3 and 4, a recess 40 is formed in the outer surface 34 of the liner 30 adjacent the rear edge 29 of the shell 20. In this embodiment, the recess 40 is rectangular in shape, although in alternative designs alternative shapes and structure may be used. In this embodiment, a control device 50 is positioned within the recess 40, between the liner 30 and the shell 20.

The control device 50 includes a means for streaming music 64 from the portable electronic device 70 to the speakers 62. In this embodiment, the means for streaming music 64 includes a receiver 65 (shown in FIG. 5) for receiving a transmission, and electronics for converting and transmitting the music to the speakers 62. The control device 50 of this embodiment includes a lower edge 52 that includes a control mechanism 54 for controlling the control device 50. The control mechanism 54 may include volume buttons 54 for controlling the volume of the music being played on the speakers 62. For purposes of this application, the term "button" is defined to include any form of control device 50, including any form of buttons, knobs, dials, or any other mechanism known in the art for controlling such electronic devices. The volume buttons 54 may also be used for controlling other functions, such as song track selection, and as a pause button.

In this embodiment, the lower edge 52 of the control device 50, and the control mechanism 54, are positioned adjacent the rear edge 29 of the shell 20, so that the user may access the control mechanism 54, while the control device 50 remains safely within the protective confines of the shell 20.

The protective helmet 10 further includes a battery 60 operably connected with the control device 50. In this embodiment, as shown in FIGS. 3-4, the battery 60 is mounted between the shell 20 and the liner 30 in a similar manner as the control device 50. In this embodiment, the battery 60 is adjacent the control device 50 in the recess 40, although in alternative embodiments it may also be placed in other recesses located in other locations in the protective helmet 10.

Similarly, side recesses 44 are formed in the outer surface 34 of the liner 30 adjacent the side edges 28 of the shell, and a speaker 62 is mounted in each of the side recesses 44 and electronically connected to the control device 50 with a speaker wire 63. As shown in FIGS. 3-4, the speaker wire 63 may be positioned in speaker wire 63 grooves 42 formed to connect the recess 40 with the side recesses 44.

Importantly, in the protective helmet 10, the control device 50 is not operably connected with a microphone, and does not transmit speech to the portable electronic device 70. The present invention is not a communications device, but a music streaming device, that is clearly distinguished from prior art systems that require microphones and two-way communications.

In this embodiment, the control device 50 includes an on/off switch 56 and a charging port 59 that is operably connected to the battery 60 via the control device 50. The control device 50 may further include an LED 58 for indicating when the control device 50 is operably connected with the protective helmet 10.

Figure 5:
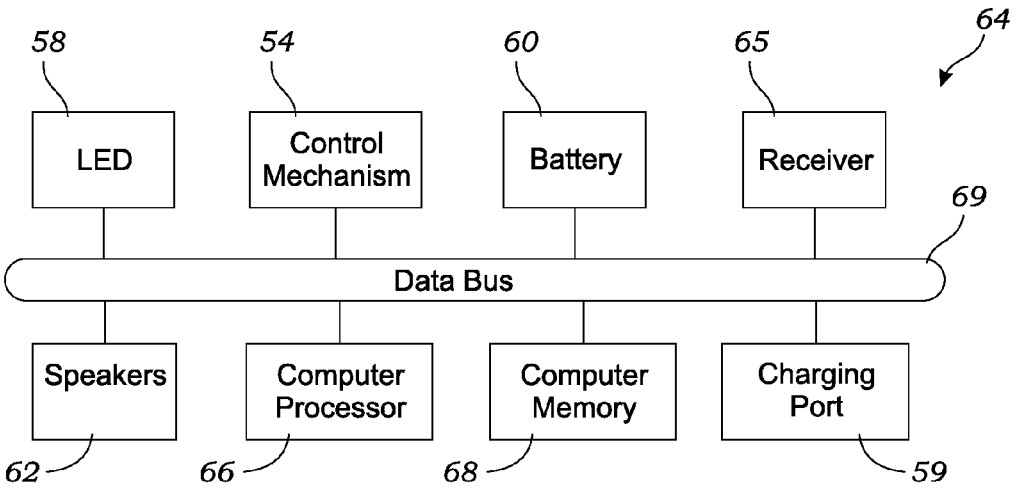
FIG. 5 is a block diagram of the electronic components of the control device.

FIG. 5 is a block diagram of the electronic components of the control device 50. As illustrated in FIG. 5, the portable electronic device 70 may include various electronic components that are operably connected, e.g., via a data bus 94, and/or via other operative and/or electronic connections. Since the construction of such components, and their operative connections, as known in the art, they are not described in greater detail herein.

Figure 6:
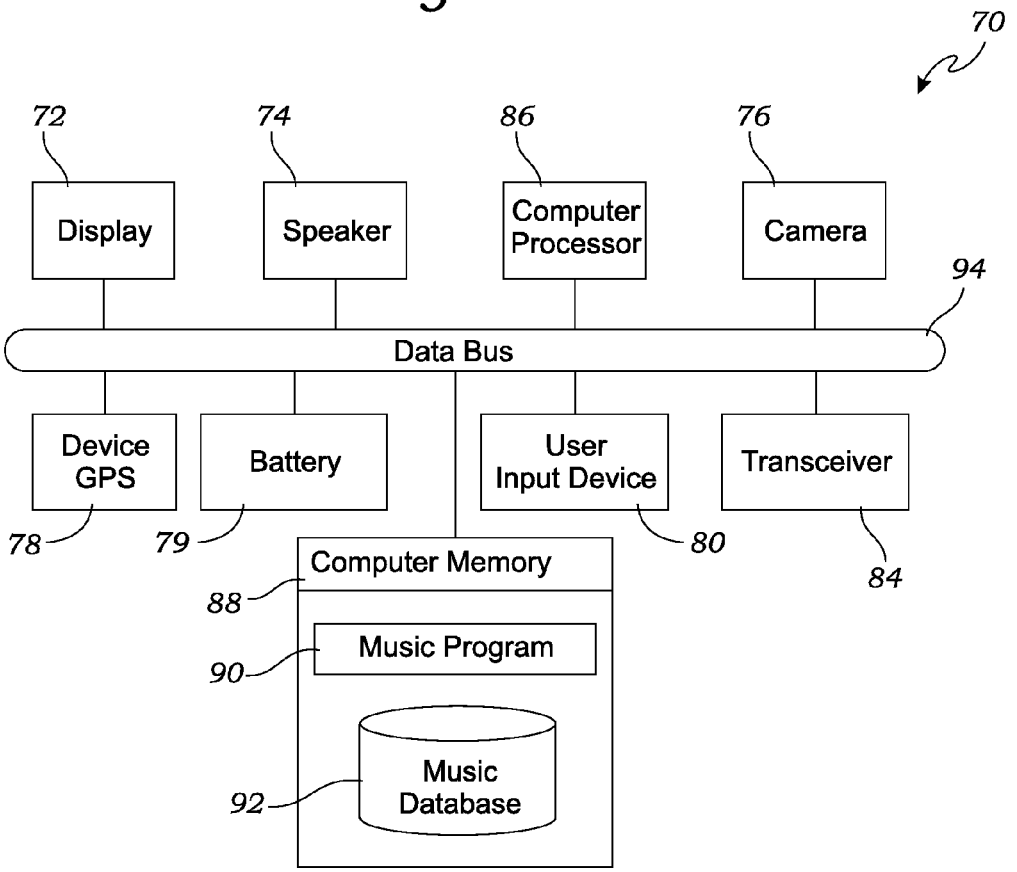
FIG. 6 is a block diagram of the electronic components of the portable electronic device of FIG. 1.

FIG. 6 is a block diagram of the operable components of the portable electronic device 70 of FIG. 1. As illustrated in FIG. 6, the portable electronic device 70 may include various electronic components known in the art for this type of device. In this embodiment, the portable electronic device 70 may include a device display 72, a speaker 74, a camera 76, a device global positioning system ("GPS") 78, a user input device 80 (e.g., touch screen, keyboard, microphone, and/or other form of input device known in the art), a user output device 170 (such as earbuds, external speakers, and/or other form of output device known in the art), a device transceiver 84 for wireless communication, a computer processor 86, a computer memory 88. A data bus 94 or similar connection may be used for interconnecting the aforementioned components. For purposes of this application, the term "transceiver" is defined to include any form of transmitter and/or receiver known in the art, for cellular, WIFI, radio, and/or other form of wireless (or wired) communication known in the art. Obviously, these elements may vary, or may include alternatives known in the art, and such alternative embodiments should be considered within the scope of the claimed invention.

In this embodiment, the portable electronic device 70 includes a music program 90 operably installed in the computer memory 88, a music database 92 that may also installed in the computer memory 88 (or streamed from a server). The music program 90 and the music database are known in the art, and may include iTUNES® or any other known music system.

There are many types of user input devices 168 that may be combined for use with the present invention. One type may be the touch-screen capability present in modern smartphones. Here, the user could adjust settings, etc.

The device transceiver 84 may be an integrated wireless transmitter/receiver combination, though a wired connection may be possible or desired in some instances. The device transceiver 84 may be used to transmit data to the protective helmet 10. Such receivers are known to those skilled in the art and their equivalents should be considered within the scope of the present invention.

As used in this application, the terms computer, processor, memory, and other computer related components, are hereby expressly defined to include any arrangement of computer (s), processor(s), memory device or devices, and/or computer components, either as a single unit or operably connected and/or networked across multiple computers (or distributed computer components), to perform the functions described herein.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A protective helmet for providing head protection to a user, and for streaming music from a portable electronic device, the protective helmet comprising:

a shell of impact-resistant material having outer and inner surfaces bounded by a front edge, two side edges, and a rear edge;

a liner of impact-absorbing material disposed on the inner surface of the shell, the liner having an inner surface and an outer surface, the inner surface of the liner defining a head-receiving cavity shaped for receiving the user's head, and the outer surface of the liner contacting the inner surface of the shell;

a recess formed in the outer surface of the liner;

a control device having a receiver for receiving a transmission from the portable electronic device, the control device being mounted in the recess, between the liner and the shell;

a battery operably connected with the control device;

side recesses formed in the outer surface of the liner adjacent the side edges of the shell;

a speaker mounted in each of the side recesses and electronically connected to the control device; and a means for streaming music from the portable electronic device to the speakers; and wherein a lower edge of the control device includes an on/off switch, a charging port, and a control mechanism that includes volume controls.

2. The protective helmet of claim 1, wherein the means for streaming music includes electronics in the control device for receiving a transmission of music data from the portable electronic device and communicating the music data to the speakers in a form that can be played on the speakers.

3. The protective helmet of claim 1, wherein the control device is not operably connected with a microphone, and does not transmit speech to the portable electronic device.

4. The protective helmet of claim 1, wherein the recess is positioned adjacent the rear edge of the shell.

5. The protective helmet of claim 1, wherein the control device has a lower edge that includes a control mechanism for controlling the control device, and wherein the battery is operably mounted between the liner and the shell adjacent the control device.

6. A music streaming system comprising:

a protective helmet comprising:

a shell of impact-resistant material having outer and inner surfaces bounded by a front edge, two side edges, and a rear edge;

a liner of impact-absorbing material disposed on the inner surface of the shell, the liner having an inner surface and an outer surface, the inner surface of the liner defining a head-receiving cavity shaped for receiving the user's head, and the outer surface of the liner contacting the inner surface of the shell;

a recess formed in the outer surface of the liner adjacent the rear edge of the shell;

a control device having a receiver for receiving a transmission, the control device having a lower edge that includes a control mechanism for controlling the control device, the control device being mounted in the recess, between the liner and the shell, such that the control mechanism is positioned adjacent the rear edge of the shell;

a battery mounted between the liner and the shell and operably connected with the control device;

side recesses formed in the outer surface of the liner adjacent the side edges of the shell;

a speaker mounted in each of the side recesses and electronically connected to the control device;

a portable electronic device having a computer processor; a computer memory, and a music program for playing music operably installed on the computer memory; and a means for streaming music from the portable electronic device to the speakers.

7. The system of claim 6, wherein the means for streaming music includes electronics in the control device for receiving a transmission of music data from the portable electronic device and communicating the music data to the speakers in a form that can be played on the speakers.

8. The system of claim 6, wherein the control device is not operably connected with a microphone, and does not transmit speech to the portable electronic device.

9. The system of claim 6, wherein the recess is rectangular in shape.

10. The system of claim 6, wherein the lower edge of the control device includes an on/off switch, a charging port, and wherein the control mechanism includes volume controls.

11. A method for streaming music to a user wearing a helmet, the method comprising the steps of:

providing a protective helmet comprising:

a shell of impact-resistant material having outer and inner surfaces bounded by a front edge, two side edges, and a rear edge;

a liner of impact-absorbing material disposed on the inner surface of the shell, the liner having an inner surface and an outer surface, the inner surface of the liner defining a head-receiving cavity shaped for receiving the user's head, and the outer surface of the liner contacting the inner surface of the shell;

a recess formed in the outer surface of the liner;

a control device having a receiver for receiving a transmission, the control device having a lower edge that includes a control mechanism for controlling the control device, the control device being mounted in the recess, between the liner and the shell;

a battery operably connected with the control device;

side recesses formed in the outer surface of the liner adjacent the side edges of the shell; and a speaker mounted in each of the side recesses and electronically connected to the control device;

providing a portable electronic device having a computer processor; a computer memory, and a music program for playing music operably installed on the computer memory; and streaming music from the portable electronic device wirelessly to the control device of the protective helmet and playing the music on the speakers.

12. A protective helmet for providing head protection to a user, and for streaming music from a portable electronic device, the protective helmet comprising:

a shell of impact-resistant material having outer and inner surfaces bounded by a front edge, two side edges, and a rear edge;

a liner of impact-absorbing material disposed on the inner surface of the shell, the liner having an inner surface and an outer surface, the inner surface of the liner defining a head-receiving cavity shaped for receiving the user's head, and the outer surface of the liner contacting the inner surface of the shell;

a recess formed in the outer surface of the liner;

a control device having a receiver for receiving a transmission from the portable electronic device, the control device being mounted in the recess, between the liner and the shell;

a battery operably connected with the control device;

side recesses formed in the outer surface of the liner adjacent the side edges of the shell;

a speaker mounted in each of the side recesses and electronically connected to the control device;

a means for streaming music from the portable electronic device to the speakers; and wherein the control device has a lower edge that includes a control mechanism for controlling the control device, and wherein the battery is operably mounted between the liner and the shell adjacent the control device.

* * * * *